US012276426B2

(12) United States Patent
Weilert et al.

(10) Patent No.: US 12,276,426 B2
(45) Date of Patent: Apr. 15, 2025

(54) HANDLE

(71) Applicant: Solo Brands, LLC, Grapevine, TX (US)

(72) Inventors: Jeffrey R. Weilert, Southlake, TX (US); Alexander K. Maghsadi, Lewisville, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/358,678

(22) Filed: Jul. 25, 2023

(65) Prior Publication Data

US 2024/0027071 A1 Jan. 25, 2024

Related U.S. Application Data

(62) Division of application No. 17/150,805, filed on Jan. 15, 2021, now Pat. No. 11,828,470.

(51) Int. Cl.
*F24B 1/191* (2006.01)
*F24B 1/181* (2006.01)

(52) U.S. Cl.
CPC ..... *F24B 1/191* (2013.01); *F24B 1/181* (2013.01)

(58) Field of Classification Search
CPC .. F24B 1/191; F24B 1/181; F24B 3/00; F24C 15/26; G05G 1/00; B65D 23/10
See application file for complete search history.

(56) References Cited

U.S. PATENT DOCUMENTS

| | | | | |
|---|---|---|---|---|
| 4,964,522 | A * | 10/1990 | Umetsu | B29C 49/20 215/386 |
| 6,227,843 | B1 | 5/2001 | Pedersen | |
| 8,851,312 | B2 | 10/2014 | Itokawa | |
| 9,038,620 | B2 | 5/2015 | Brown | |
| 10,849,457 | B2 | 12/2020 | Bell | |
| 2001/0042731 | A1 | 11/2001 | Itokawa | |
| 2008/0173655 | A1 | 7/2008 | Navarro | |
| 2018/0170616 | A1 | 6/2018 | Usami | |

* cited by examiner

*Primary Examiner* — Alfred Basichas
(74) *Attorney, Agent, or Firm* — Haynes and Boone, LLP

(57) ABSTRACT

A handle for carrying a component having an opening to a cavity may include a frame configured to span a cavity in the component, the frame having a grasp region. The handle may further include a first support brace on the frame configured to selectively engage a first wall of the component. The first support brace may be spaced a first distance from the grasp region. The handle may further include a second support brace on the frame configured to selectively engage a second wall of the component. The second support brace may be spaced a second distance from the grasp region, the second distance being greater than the first distance.

18 Claims, 7 Drawing Sheets

HANDLE

PRIORITY CLAIM

This application is a divisional of U.S. patent application Ser. No. 17/150,805, filed Jan. 15, 2021, titled "Handle," which is incorporated herein by reference in its entirety.

TECHNICAL FIELD

The subject matter described herein relates to a handle for lifting, moving, or other manipulation of a moveable item, such as a firepit.

BACKGROUND

Free-standing firepits are becoming more commonplace for campers, backyard enthusiasts, and others who desire a fire for ambiance or cooking while having easy containment and simple cleanup. Some of these firepits can be large enough and heavy enough to require some effort to move them about a campsite, a yard or other area. While some firepits may be tipped and rolled, or lifted with the help of multiple people, these firepits can be bulky and unwieldy for moving or packing by a single person.

SUMMARY

The present disclosure is directed to a carry handle for a moveable item, such as a firepit. In some aspects, the carry handle may enable a user to lift and carry the firepit from one location to another. For example, the handle may assist when carrying the firepit from a vehicle to a campsite or vice-versa, about a backyard, or anywhere else desired. In some aspects, the carry handle easily engages and disengages with the firepit.

The present disclosure is directed to a handle for carrying a component (e.g., a firepit) having an opening to a cavity. The handle may include a frame configured to span the cavity of the component, with the frame having a grasp region. A first support brace on the frame may be configured to selectively engage a first wall of the component, with the first support brace being spaced a first distance from the grasp region. A second support brace on the frame may be configured to selectively engage a second wall of the component. The second support brace may be spaced a second distance from the grasp region, and the second distance may be greater than the first distance.

In an aspect, the distance from the first support brace to the second support brace is greater than a distance across the cavity of the component. In an aspect, the first support brace comprises a projection tab configured to engage a securement feature of the component. In an aspect, the first support brace further comprises an engagement surface, the securement feature projecting outwardly beyond the engagement surface. In an aspect, the first support brace comprises a polymeric bumper, the engagement surface forming a part of the polymeric bumper. In an aspect, the projection tab projects at an angle relative to the grasp region of the frame. In an aspect, the second support brace has an engagement surface to abut against a wall of the component. In an aspect, the second support brace comprises a polymeric bumper, the engagement surface forming a part of the polymeric bumper. In an aspect, the frame comprises a first beam and a second beam, the second beam being angled relative to the first beam. In an aspect, the handle may comprise a grip on the grasp region of the frame, the grip being configured to be grasped by a user.

The present disclosure is also directed to a handle for lifting a firepit having an opening to a cavity defined between a first surface and a second surface with the first surface having a securement feature. The handle may include a frame configured to span a cavity in the firepit. The frame having a grasp region shaped to be substantially horizontal when the handle is used to lift the firepit. The handle also may include a first support brace on the frame having a projection tab configured to selectively engage the securement feature of the first surface of the firepit. The first support brace may be spaced a first distance from the grasp region. The handle may also include a second support brace on the frame configured to selectively abut against the second surface of the firepit. The second support brace may be devoid of a projection tab. The second support brace may be spaced a second distance from the grasp region, the second distance being greater than the first distance.

In an aspect, the distance from the first support brace to the second support brace is greater than a distance across the cavity of the firepit. In an aspect, the first support brace further comprises an engagement surface, the securement feature projecting outwardly beyond the engagement surface. In an aspect, the projection tab projects at an angle relative to the grasp region of the frame. In an aspect, the second support brace comprises a polymeric bumper having an engagement surface to abut against a wall of the firepit. In an aspect, the handle may comprise a grip on the grasp region of the frame, the grip being configured to be grasped by a user.

The present disclosure is also directed to a method of attaching a removeable handle to a firepit to lift the firepit. The method may include inserting the handle through an opening into a cavity of the firepit; engaging a first support brace with a securement feature in a first wall of the cavity at a first depth in the cavity; and engaging a second support brace with a second wall of the cavity opposite the first wall by pivoting the handle about the engaged first support brace. The second support brace may engage the second wall at a second depth in the cavity different than the first depth.

In some implementations, engaging the first support brace with the securement feature comprises inserting a projection on the first support brace through a hole the first wall of the cavity. In some implementations, engaging the second support brace with the second wall comprises engaging the second wall with a friction engagement. In some implementations, the method may comprise introducing the second support brace into the cavity before the first support brace.

BRIEF DESCRIPTION OF THE DRAWINGS

Illustrative embodiments of the present disclosure will be described with reference to the accompanying drawings, of which.

Figure 1:
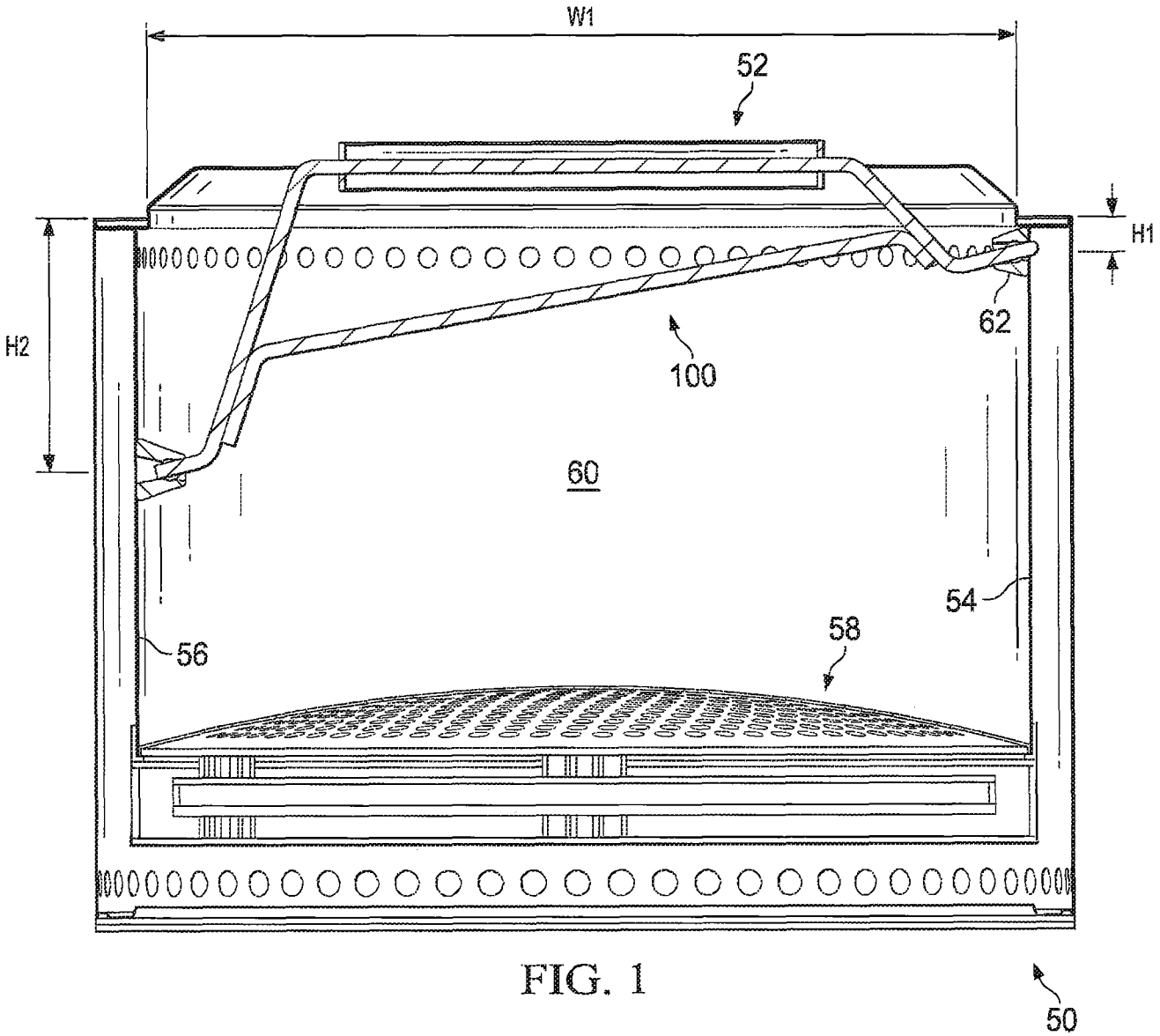
FIG. 1 is a cross-sectional illustration of a handle attached to a firepit in accordance with at least one embodiment of the present disclosure.

Embodiments of the present disclosure and their advantages are described in the detailed description that follows. It should be appreciated that like reference numerals are used to identify like elements illustrated in one or more of the figures for purposes of illustrating but not limiting embodiments of the present disclosure.

DETAILED DESCRIPTION

For the purposes of promoting an understanding of the principles of the present disclosure, reference will now be made to the embodiments illustrated in the drawings, and specific language will be used to describe the same. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately. These descriptions are provided for exemplary purposes only and should not be considered to limit the scope of the handle for a firepit. Certain features may be added, removed, or modified without departing from the spirit of the claimed subject matter.

FIG. 1 is a cross-sectional illustration of an example handle 100 usable to lift or carry an item, such as a firepit 50. The handle 100 is easily attachable to and removeable from the firepit through simple maneuvering of the handle 100 relative to the firepit 50. As will become apparent by the description herein, the handle 100 can be securely connected to the firepit 50 by using the weight of the firepit 50 as leverage to hold the handle 100 in a stable manner. Further, the handle lacks unwieldy attachments, such as threads or adhesives. The examples herein describe the handle with reference to the firepit 50. However, that handle 100 may have other applications with components other than a firepit.

The handle 100 in FIG. 1 selectively engages with interior surfaces of the firepit Here, the firepit 50 includes an upper opening 52, an interior wall 54, an interior wall 56, and a floor or bottom structure 58. The interior walls 54, 56 and the bottom structure 58 define a cavity 60 which in some embodiments, is a burning chamber. The example firepit described herein is cylindrical and the opening 52 is therefore around. However, other examples may have other shapes. The interior walls 54, 56 include a securement feature 62 formed therein. In this implementation, the securement feature 62 is a hole through the interior surface. In other implementations, the securement feature 62 may be a notch or a shoulder or other shaped construct that may allow the handle 100 to mechanically engage the wall defining the cavity 60. As shown, the handle 100 may be disposed within the cavity 60 of the firepit 50 in a manner that the handle 100 engages the securement feature 62 along the interior wall 54 while abutting against a smooth surface of the opposing interior wall 56.

Still with reference to FIG. 1, the handle 100 spans the distance (width W1) between the interior wall 54 and the interior wall 56, representing the width of the cavity 60. In some implementations, width W1 may also correspond to the width of the opening 52. The example handle 100 in FIG. 1 engages the firepit 50 at two locations that are disposed at different elevations from the opening 52. For example, a first portion of the handle 100 engages the interior wall 54 at a distance H1 from the opening 52, while a second portion of the handle 100 engages the interior wall 56 at a distance H2 to from the opening 52.

Figure 2:
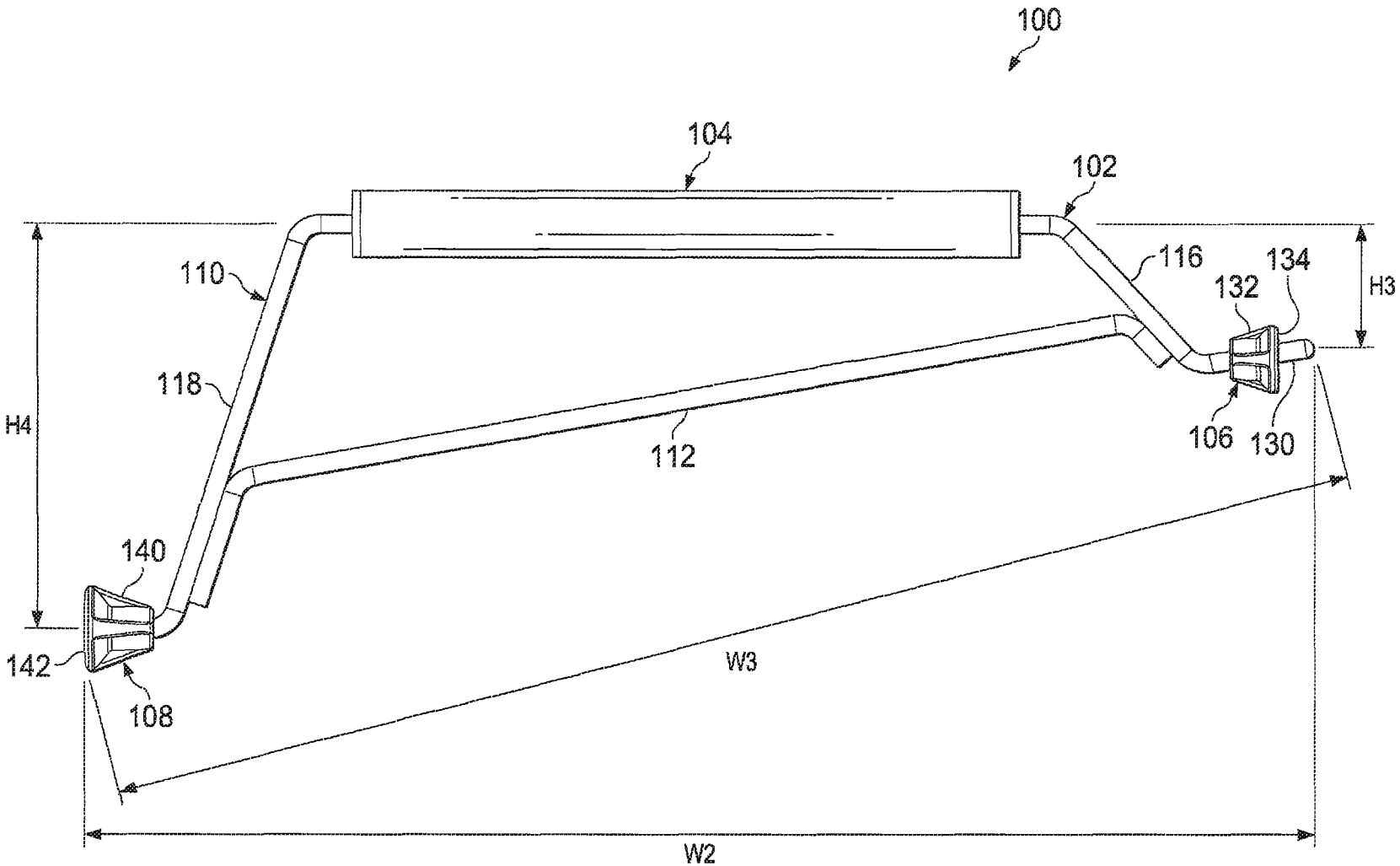
FIG. 2 is an illustration of a plan view of the handle in accordance with at least one embodiment of the present disclosure.
Figure 3:
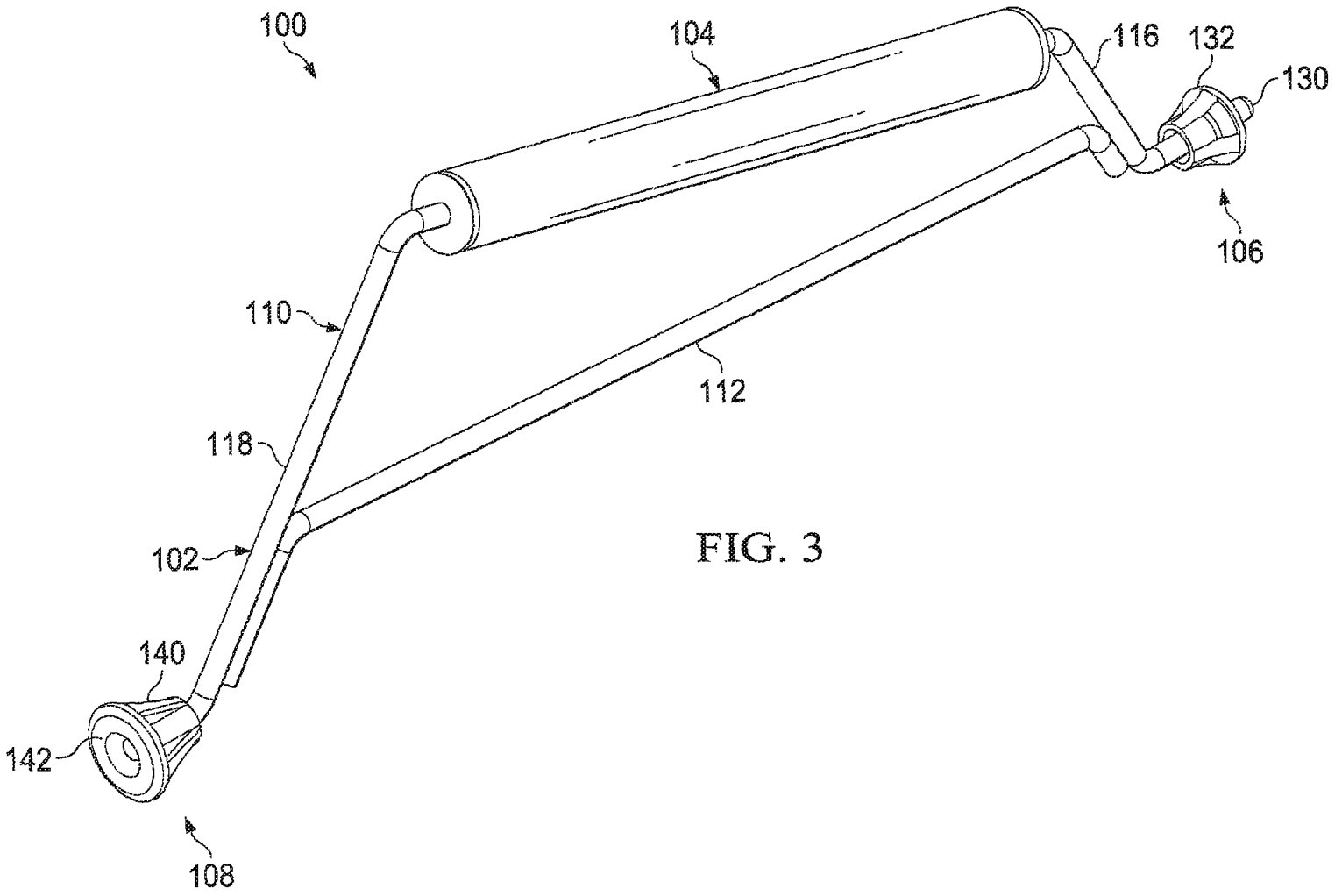
FIG. 3 is an illustration of a perspective view of the handle in accordance with at least one embodiment of the present disclosure.
Figure 4:
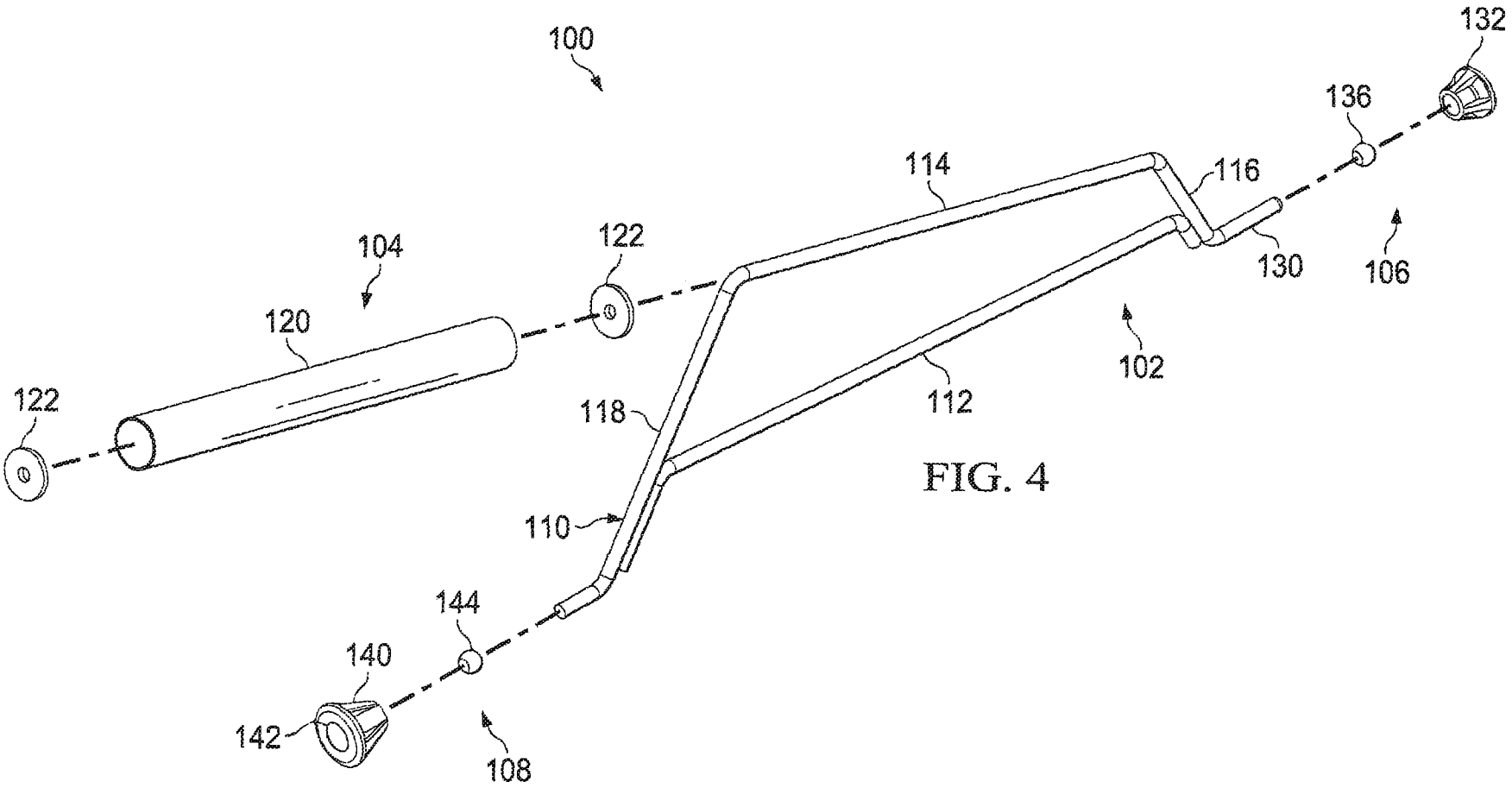
FIG. 4 is an illustration of an exploded perspective view of the handle in accordance with at least one embodiment of the present disclosure.

FIGS. 2-4 show the handle 100 independent of the firepit 50. The handle 100 includes a frame 102, a grip 104, an upper support brace 106, and a lower support brace 108. As can be seen in FIG. 2, the handle 100 includes a horizontal width W2 and includes an angled width W3 representing the distance between the upper support brace 106 and the lower support brace 108. The width W2 is less than the width W3. Further, with reference to FIGS. 1 and 2, the width W2 may generally correspond to the width W1 between the interior walls 54, 56 of the firepit. As such, the width W3 is greater than the width W1 of the firepit 50. Further, the handle 100 includes a height H3 showing a spaced distance between the grip 104 and the upper support brace 106. The handle 100 also includes a height H4 showing a spaced distance between the grip 104 and the lower support brace 108. The height H3 is less than the height H4.

In this example, the frame 102 includes a gripping beam 110 and a stabilizing beam 112. The gripping beam 110 includes a grasp region 114 and respective connector regions 116, 118. In this example, the grasp region 114 is shaped and formed to be in a substantially horizontal position when the handle 100 is used to connect with the firepit (FIG. 1). The connector regions 116, 118 respectively connect the grasp region 114 to the upper support brace 106 and the lower support brace 108. FIGS. 2-4 show the connector region 116 extending from the grasp region 114 toward the upper support brace 106, and the connector region 118 extending from the grasp region 114 toward the lower support brace 108. The connector region 116 is shorter than the connector region 118. In the implementation shown the gripping beam 110 includes tips or ends that form a part of the upper support brace 106 and the lower support brace 108. These tips or ends are described further below.

The stabilizing beam 112 extends between and connects the connector regions 116, 118. In this implementation, the stabilizing beam 112 may provide additional structural rigidity to the frame 102 and is non-parallel with the grasp region 114. In the implementation shown, the frame 102 is formed of two cylindrical bars that are fixedly connected to one another, such as by welding. Other implementations may include a frame formed of a single plate or other rigid structure sufficient to rigidly maintain the upper support brace 106 and the lower support brace 108 in place when the handle 100 is connected to a structure to be moved, such as the firepit 50.

The grip 104 is disposed on the frame 102 and provides a comfortable gripping surface for user. In the implementation shown, the grip 104 comprises a tube 120 with end plugs 122 (best shown in FIG. 4). The end plugs 122 may be disposed in the end of the tube 120. In this example, the gripping beam 110 extends through the end plugs 122 and the tube 120. Although the grip 104 is shown as being cylindrical, other implementations are contemplated including additional comfort features, such as ergonomic finger locations or other features that may provide additional comfort to a user's hand. In some implementations. In some implementations, the grip 104 is formed of a metal material, and in some implementations, is formed of stainless steel. In other implementations, the grip 104 may be formed of a polymer or a padded material such as a foam, or other material that may be comfortable to a user's hand. Depending upon the implementation, the grip 104 may rotate about the gripping beam 110, or the grip 104 may be fixed to the gripping beam 110 in a manner that prevents rotation.

The grasp region 114 and the tube 120 may have any length, but in some implementations, have a length that is between about 50% and 95% of the width W1 (FIG. 1) between the interior wall 54 and the interior wall 56. The grasp region 114 and the tube 120 may also extend between about 50% and 95% of the width of the opening 52. In other implementations, the grasp region 114 and the tube 120 may extend between about 60% and 90% of the width of the opening 52 or the width W1. With the grasp region 114 and the tube 120 within these ranges, a user may comfortably lift and carry the firepit in different ways. For example, carrying can be done to the side of the user's body with one hand or in front of the body with two hands. Further, the width of the grasp region 114 and the tube 120 may allow two people to carry the firepit if necessary, one on each side of the firepit.

The upper support brace 106 is configured to engage the interior wall 54 of the firepit 50, and the lower support brace 108 is configured to engage the opposing interior wall 56 of the firepit 50, as shown in FIG. 1. In the implementation shown, the upper support brace 106 includes a projecting tab 130 and a bumper 132. In the implementation shown, the projecting tab 130 is formed of a part of the gripping beam 110, and therefore is a rigid projection formed as a metal bar. However, in other implementations, the projecting tab 130 may be formed in a manner that does not incorporate a portion of the gripping beam 110. In such alternative embodiments, the projecting tab 130 may be formed of another portion of the upper support brace 106, and may be supported by the gripping beam 110. In this implementation, the projecting tab 130 projects outwardly from an end of the connector region 116 of the gripping beam 110 at an angle that is not parallel with the grasp region 114. Here, the projecting tab 130 projects at an upward angle between about 10 degrees to 45 degrees to engage the securement feature 62 of the firepit 50, as shown in FIG. 1. Other angles, both larger and smaller, are contemplated. Here, the projecting tab 130 is cylindrical and configured to fit within a hole disposed in the interior wall 54 of the firepit 50.

In the example shown, the bumper 132 is supported by the gripping beam 110 and extends about the projecting tab 130. In this implementation, the bumper 132 includes an engagement surface 134 configured to abut against the interior wall 54 of the firepit 50, even as the projecting tab 130 extends through the interior wall 54. In some implementations, the bumpers are designed to rotate and be free-moving. This may allow the handle 100 to adjust into position quicker and also allows slight back and forth movement of the firepit to coincide with the gait of the person carrying. This may provide a more natural carrying experience as the inertia of the firepit adjusts to the person's walking motion.

The bumper 132 may be formed of any material, and in some examples, is formed of a polymeric material or rubber that provides sufficient support with minimal risk of scratching or deforming the interior wall of the firepit. Other materials, including metal materials, ceramics, wood, foams, or other materials are also contemplated. In the implementation shown, the bumper 132 may be attached to the gripping beam 110 via a fastener 136, shown in the exploded view. Here, the fastener 136 is a crimp that may be locked about the gripping beam to secure the upper support brace 106 in place. However, any fastening element may be used to attach the upper support brace 106 to the frame 102.

The lower support brace 108 is disposed at an end of the connector region 118 of the gripping beam 110 of the frame 102. In the implementation shown, the end of the gripping beam 110 may extend into and therefore may form a part of the lower support brace 108. However, in other implementations, the gripping beam 110 may not form any part of the lower support brace 108. While the lower support brace 108 includes a bumper 140, the lower support brace 108 is devoid of a projecting structure. The bumper 140 includes an engagement surface 142 that is configured to about directly against the interior wall 56 of the firepit 50 (FIG. 1). In some implementations, the projecting tab 130 may support a substantial portion of the weight of the firepit 50, and the force from the downward moment forces the interior wall 56 against the bumper 140, stabilizing the firepit 50 when the handle 100 is in place. As such, the bumper 140 may be held in place along the interior wall 56 via only friction engagement. The description of the bumper 132 also applies to the bumper 140 and is not repeated here. In the implementation shown, the bumper 140 may be attached to the gripping beam 110 via a fastener 144, shown in the exploded view. However, any fastening element may be used to attach the upper support brace 106 to the frame 102.

Figure 5A:
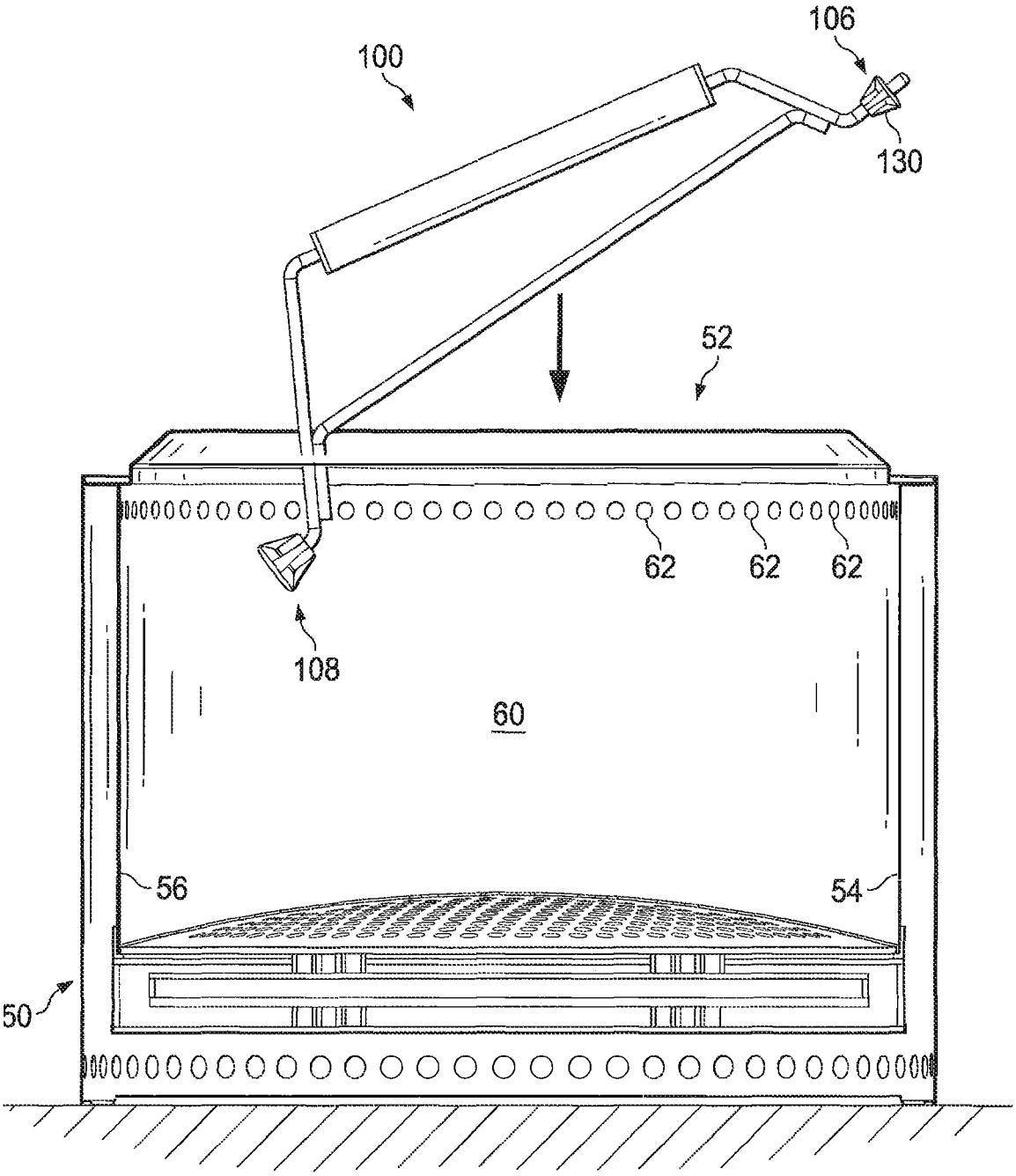
FIGS. 5A, 5B, and 5C are illustrations of cross-sectional plan views of the handle being attached to the firepit in accordance with at least one embodiment of the present disclosure.
Figure 5B:
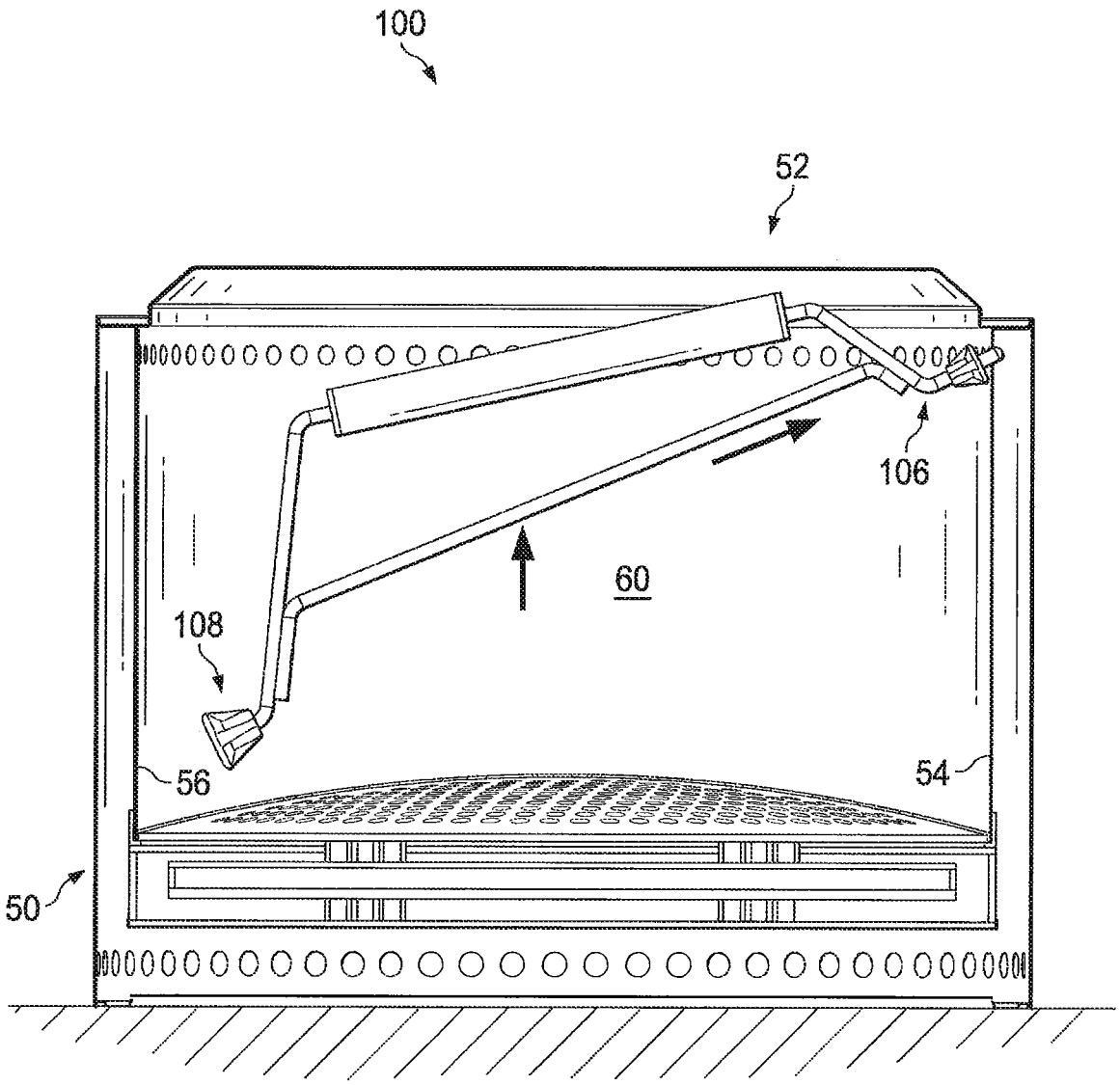
Figure 5C:
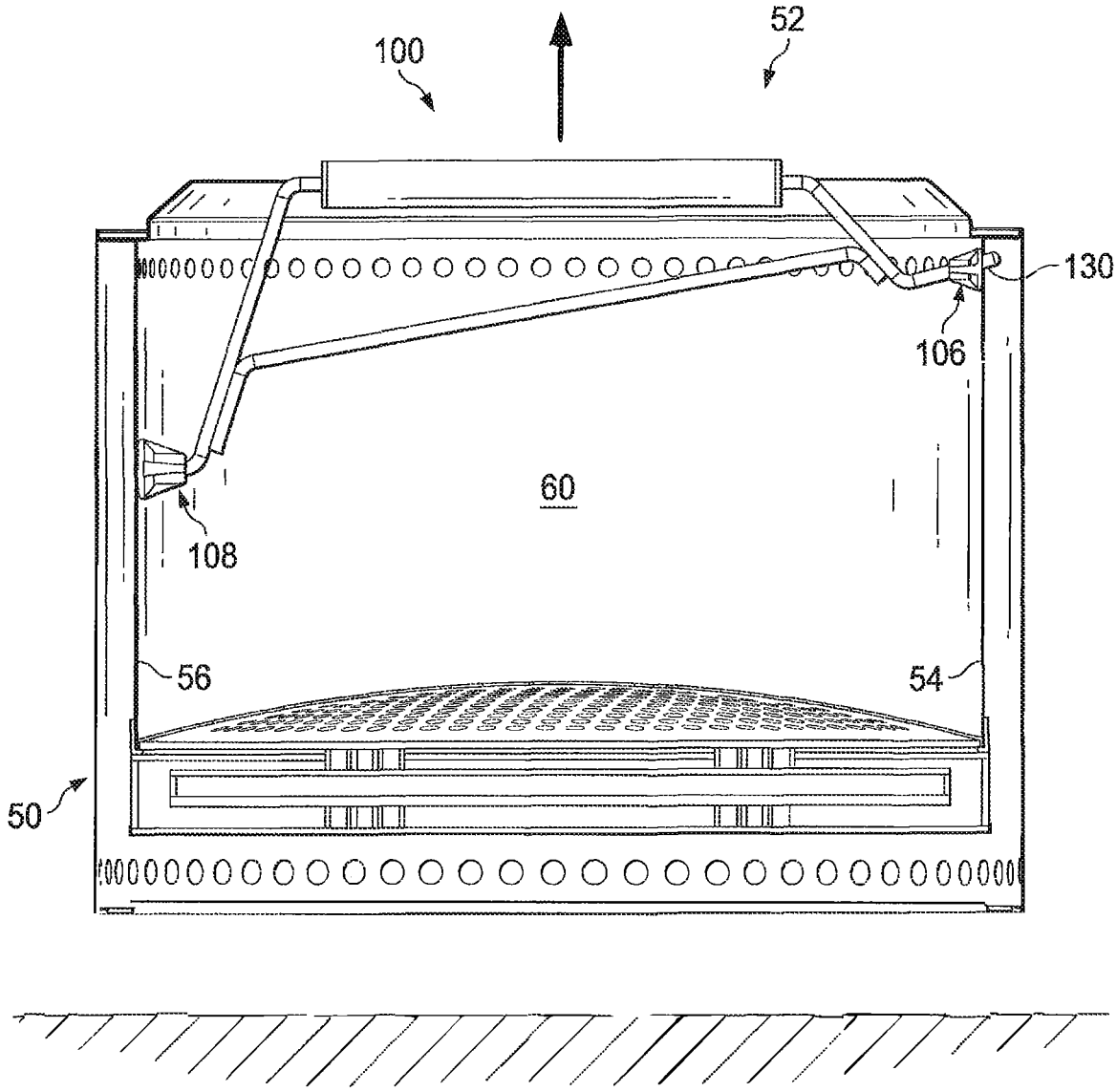

FIGS. 5A-5C are illustrations showing a method of attaching the handle 100 to a firepit. Referring to FIG. 5A, the handle 100 is introduced through the opening 52 of the firepit 50. Because the handle 100 includes a width W3 that is larger than the width W1 of the opening 52, the handle 100 may be introduced at an angle. In this implementation, the lower support brace 108 is introduced though the opening 52 into the cavity 60 before the upper support brace 106. The handle 100 may be displaced into the cavity 60 until both the upper support brace 106 and the lower support brace 108 are fully within the cavity 60.

As shown in FIG. 5B, when the handle 100 reaches a sufficient depth within the cavity 60 of the firepit 50, the upper support brace 106 may be manipulated to engage the securement feature 62 of the firepit 50. In the implementation shown, the securement feature 62 is any hole of a series of holes that extend entirely about the circumference of the interior surface of the firepit 50, with the interior surface forming both the interior wall 54 and the interior wall 56. The projection tab 130 may be introduced through one of the holes forming the securement feature 62. As indicated herein, the securement feature 62 may be formed of other features such as, for example only, a shoulder, a notch, a hook, or other feature that might securely engage with the upper support brace 106. In this implementation, because the projecting tab 130 is formed at an angle relative to the grasp region 114, the projecting tab 130 may serve as a hook.

With the projecting tab 130 engaged by the securement feature 62 of the firepit, the upper support brace 106 may function as a fulcrum for the handle 100. That is, as the handle 100 is raised toward the opening 52 of the fire, the handle 100 pivots about the projection tab 130 in the securement feature 62 until the lower support brace 108 engages against the interior wall 56 of the cavity 60.

FIG. 5C shows the handle 100 completely engaged in the firepit 50, permitting the firepit to be lifted by the handle 100. Accordingly, the handle embodiment shown in FIG. 5C includes an upper support brace 106 that mechanically engages via interference with the firepit, while the lower support brace 108 merely abuts against the inner wall of the firepit.

As will be readily appreciated by those having ordinary skill in the art after becoming familiar with the teachings herein, the present disclosure enables a single person to more easily lift, carry, and otherwise manipulate a firepit. This may improve a user's experience by enabling easier set up and easier clean-up than conventional firepits. Although described with reference to a firepit, the handle may be used to lift and carry other components or systems that have an opening through with the handle may be introduced. For example, the handle may be utilized to carry buckets, pails, pipes or other tools, equipment or components having an opening through which the handle may be introduced.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and are not intended to create limitations, particularly as to the position, orientation, or use of the handle with the firepit. As such, connection references do not necessarily imply that two elements are directly connected and in fixed relation to each other.

Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A handle for carrying a component having an opening to a cavity, the handle comprising:

a frame configured to span a cavity in the component, the frame having a grasp region and comprising:

a first support brace on the frame configured to selectively engage a first wall of the component, the first support brace being spaced a first distance from the grasp region;

a second support brace on the frame configured to selectively engage a second wall of the component, the second support brace being spaced a second distance from the grasp region, the second distance being greater than the first distance;

a first beam extending between the first support brace and the second support brace; and a second beam extending between the first support brace and the second support brace.

2. The handle of claim 1, wherein a distance from the first support brace to the second support brace is greater than a distance across the cavity of the component.

3. The handle of claim 1, wherein the first support brace comprises a projection tab configured to engage a securement feature of the component.

4. The handle of claim 3, wherein the first support brace further comprises an engagement surface, the projection tab projecting outwardly beyond the engagement surface.

5. The handle of claim 4, wherein the first support brace comprises a bumper, the engagement surface forming a part of the bumper.

6. The handle of claim 3, wherein the projection tab projects at an angle relative to the grasp region of the frame.

7. The handle of claim 3, wherein the securement feature comprises a hole in the first wall through which the projection tab is configured to extend.

8. The handle of claim 1, wherein the second support brace has an engagement surface to abut against a wall of the component.

9. The handle of claim 8, wherein the second support brace comprises a bumper, the engagement surface forming a part of the bumper.

10. The handle of claim 9, wherein when the first support brace is engaged with the first wall and the second support brace is engaged with the second wall, friction holds the bumper in place along the second wall, and wherein the bumper is configured to rotate with respect to the frame.

11. The handle of claim 1, wherein the second beam is angled relative to the first beam.

12. The handle of claim 11, further comprising a first connector region connecting the grasp region to the first support brace and a second connector region connecting the grasp region to the second support brace, wherein the second connector region is longer than the first connector region.

13. The handle of claim 12, wherein the second beam is a stabilizing beam extending between the first connector region and the second connector region, and wherein the first beam forms the grasp region, the first connector region, and the second connector region.

14. The handle of claim 13, wherein the first beam further forms a part of the first support brace and a part of the second support brace.

15. The handle of claim 1, comprising a grip on the grasp region of the frame, the grip being configured to be grasped by a user.

16. The handle of claim 15, wherein the grip is configured to rotate freely around the grasp region of the frame.

17. A handle for carrying a component having an opening to a cavity, the handle comprising:

a frame configured to span a cavity in the component, the frame having a grasp region;

a first support brace on the frame configured to selectively engage a first wall of the component, the first support brace being spaced a first distance from the grasp region; and a second support brace on the frame configured to selectively engage a second wall of the component, the second support brace being spaced a second distance from the grasp region, the second distance being greater than the first distance, wherein the second support brace has an engagement surface to abut against a wall of the component, wherein the second support brace comprises a bumper, the engagement surface forming a part of the bumper, and wherein the bumper is configured to rotate with respect to the frame.

18. A handle for carrying a component having an opening to a cavity, the handle comprising:

a frame configured to span a cavity in the component, the frame having a grasp region;

a first support brace on the frame configured to selectively engage a first wall of the component, the first support brace being spaced a first distance from the grasp region;

a second support brace on the frame configured to selectively engage a second wall of the component, the second support brace being spaced a second distance from the grasp region, the second distance being greater than the first distance; and a grip on the grasp region of the frame, the grip being configured to be grasped by a user, wherein the grip is configured to rotate freely around the grasp region of the frame.

* * * * *